US010935043B1

(12) United States Patent
Liu

(10) Patent No.: US 10,935,043 B1
(45) Date of Patent: Mar. 2, 2021

(54) ASSEMBLY OF BLADE ASSEMBLY BRACKET AND BLADE OF CEILING FAN

(71) Applicant: PAN AIR ELECTRIC CO., LTD., Taichung (TW)

(72) Inventor: Ching-Wen Liu, Taichung (TW)

(73) Assignee: Pan Air Electric Co., Ltd., Taichung (TW)

( * ) Notice: Subject to any disclaimer, the term of this patent is extended or adjusted under 35 U.S.C. 154(b) by 0 days.

(21) Appl. No.: 16/798,856

(22) Filed: Feb. 24, 2020

(51) Int. Cl.
*F04D 29/36* (2006.01)

(52) U.S. Cl.
CPC ..... *F04D 29/36* (2013.01)

(58) Field of Classification Search
CPC ..... F04D 29/322; F04D 29/323; F04D 29/34; F04D 29/36; F04D 29/362; F04D 29/364
See application file for complete search history.

(56) References Cited

U.S. PATENT DOCUMENTS 2,869,648 A * 1/1959 Pihl ..... F04D 29/364 416/140
8,292,585 B2 * 10/2012 Liu ..... F04D 25/088 416/143
2013/0084180 A1 * 4/2013 Conley ..... F04D 29/364 416/1
2014/0241881 A1 * 8/2014 Villella ..... F21V 33/0096 416/5

* cited by examiner

*Primary Examiner* — Bryan M Lettman
(74) *Attorney, Agent, or Firm* — Rosenberg, Klein & Lee

(57) ABSTRACT

An assembly of a blade assembly bracket and a blade of a ceiling fan includes a blade assembly bracket, an adaptor, and a fan blade. The adaptor is pivoted to the blade assembly bracket, and the fan blade is pivoted to the adaptor. When the adaptor is pivoted relative to the blade assembly bracket, the adaptor can drive the rotatable holder simultaneously to switch a position of the fan blade between an initial position and a rotational position, so as to change an inclination angle of the fan blade, and make the fan blade unfold outwardly. When the operation of the ceil fan is stopped, the adaptor is operated reversely to make the fan blade fold from the outwardly-unfolded state.

9 Claims, 9 Drawing Sheets

ASSEMBLY OF BLADE ASSEMBLY BRACKET AND BLADE OF CEILING FAN

BACKGROUND OF THE INVENTION

1. Field of the Invention

The present invention relates to a ceiling fan, and more particularly to an assembly structure of a blade assembly bracket and a blade, and in the assembly structure, the blade has a range of a changeable rotation angle, that is, an inclination angle of the blade and the inclination angle of the blade relative to the blade assembly bracket can be changed.

2. Description of the Related Art

A ceiling fan is a type of fan hanging on the ceiling in a building, and when the fan blade is driven to rotate, the indoor air can be circulated more quickly. The fan blade rotated by the ceiling fan is heavy and has a large area, so the ceiling fan is equipped with a motor having a larger torque than that of the motor used in a vertical fan, and a rotation speed of the ceiling fan is lower than that of the vertical fan. Therefore, the ceiling fan can blow a larger space and is very popular with consumers, for example, the ceiling fans are often installed in the living rooms of families and used in cooperation with air conditioning systems in government offices, schools, and large restaurants.

At present, there is a ceiling fan with foldable fan blades which can be folded close to the body with a spherical appearance when not in use and can be unfolded independently or in a linked manner when in use. For example, Taiwan Utility Model Patent No. M533692, titled "small ceiling fan", Taiwan Invention Patent No. 1550192, titled "ceiling fan having blades capable of synchronously expanding and folding", and other related technologies.

The folding and unfolding operations of the fan blades of the aforementioned ceiling fan are affected by the number and size of the fan blades, and the inclination angle of the fan blades are also affected, and it limits the air circulation efficiency of this ceiling fan during operation.

In order to improve the above-mentioned ceiling fan with foldable fan blades, the inventors of the present invention develop a novel ceiling fan, according to years of practical experience in the industry, and many experiments and product trials.

SUMMARY OF THE INVENTION

An objective of the present invention is to provide an assembly of a blade assembly bracket and a blade of a ceiling fan, so as to solve the drawbacks of the conventional ceiling fan.

In order to achieve the aforementioned objective and effect, the present invention provide an assembly of a blade assembly bracket and a blade of a ceiling fan, and the assembly includes a blade assembly bracket, an adaptor and a fan blade. The blade assembly bracket is assembled with an end of a fixed shaft, and the fixed shaft has a plurality of fixed teeth formed and arranged annularly on other end thereof. The adaptor is pivoted to the blade assembly bracket, and includes a receiving portion, and a through hole and a rotary hole respectively formed on circumferential sides thereof and in communication with the receiving portion axially and radially. The end of the fixed shaft with the plurality of fixed teeth is inserted through the through hole and located inside the receiving portion. The fan blade includes a blade, a rotatable holder, and a gear member. Two ends of the rotatable holder are respectively assembled with the blade and the gear member, and a portion, assembled with the blade, of the rotatable holder is exposed out of the rotary hole of the adaptor, and a portion, assembled with the gear member, of the rotatable holder is pivoted through the rotary hole. The gear member is disposed in the receiving portion and has a plurality of rotation teeth engaged with the plurality of fixed teeth, and when the adaptor is pivoted relative to the blade assembly bracket, the plurality of rotation teeth of the gear member are engaged and rotated along the plurality of fixed teeth of the fixed shaft, and the gear member simultaneously drives the rotatable holder and the blade to switch between an initial position and a rotational position, to change an inclination angle of the blade.

BRIEF DESCRIPTION OF THE DRAWINGS

The structure, operating principle and effects of the present invention will be described in detail by way of various embodiments which are illustrated in the accompanying drawings.

DETAILED DESCRIPTION OF THE PREFERRED EMBODIMENTS

Figure 1:
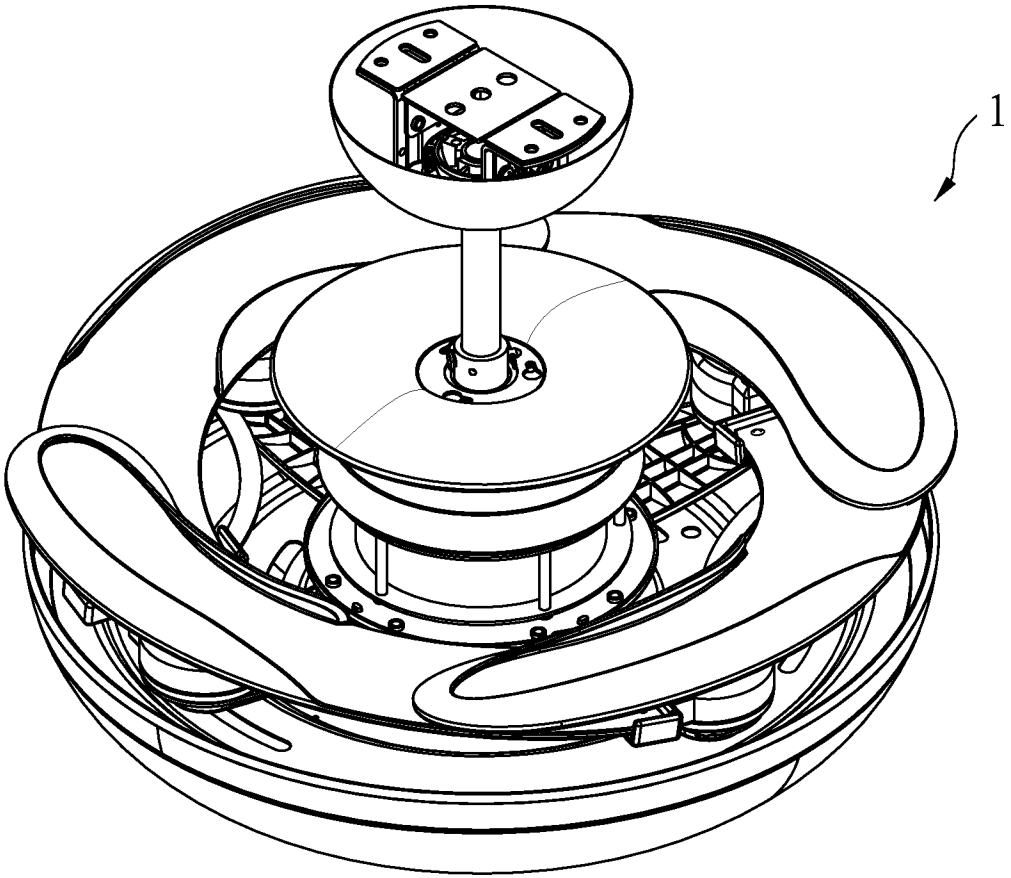
FIG. 1 is a perspective view of a ceiling fan with fan blades in a folded state.
Figure 2:
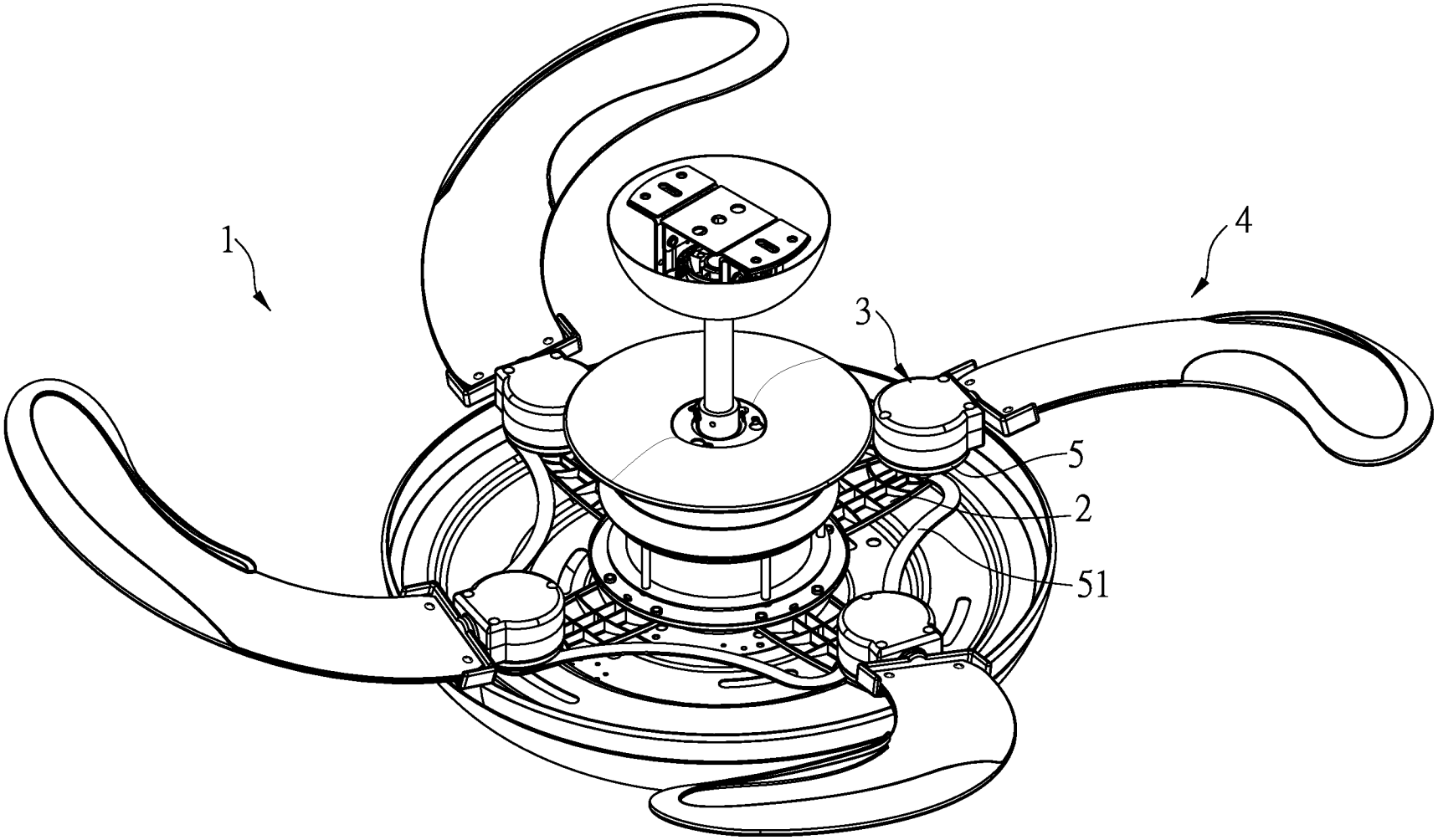
FIG. 2 is a perspective view of a ceiling fan with fan blades in an unfolded state.
Figure 3:
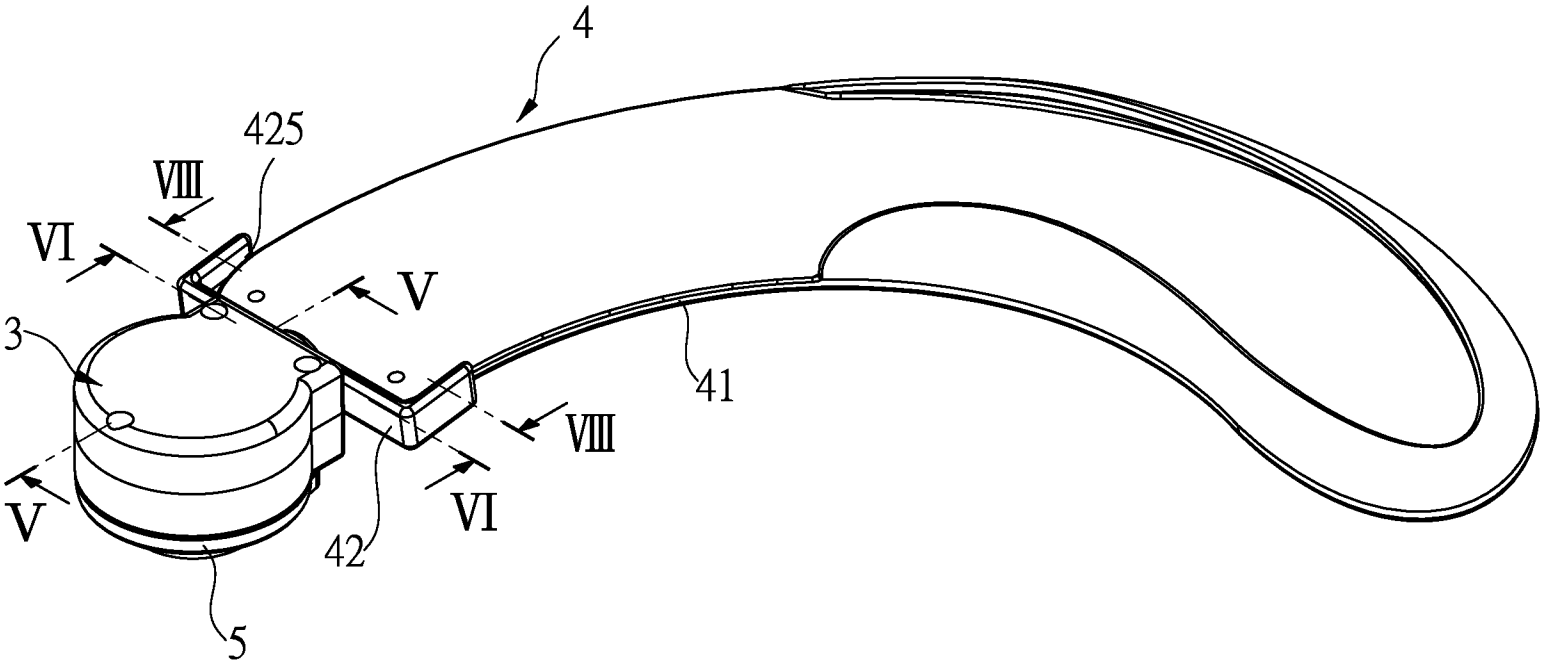
FIG. 3 is a perspective view of an adaptor and a fan blade of a ceiling fan of the present invention.
Figure 4:
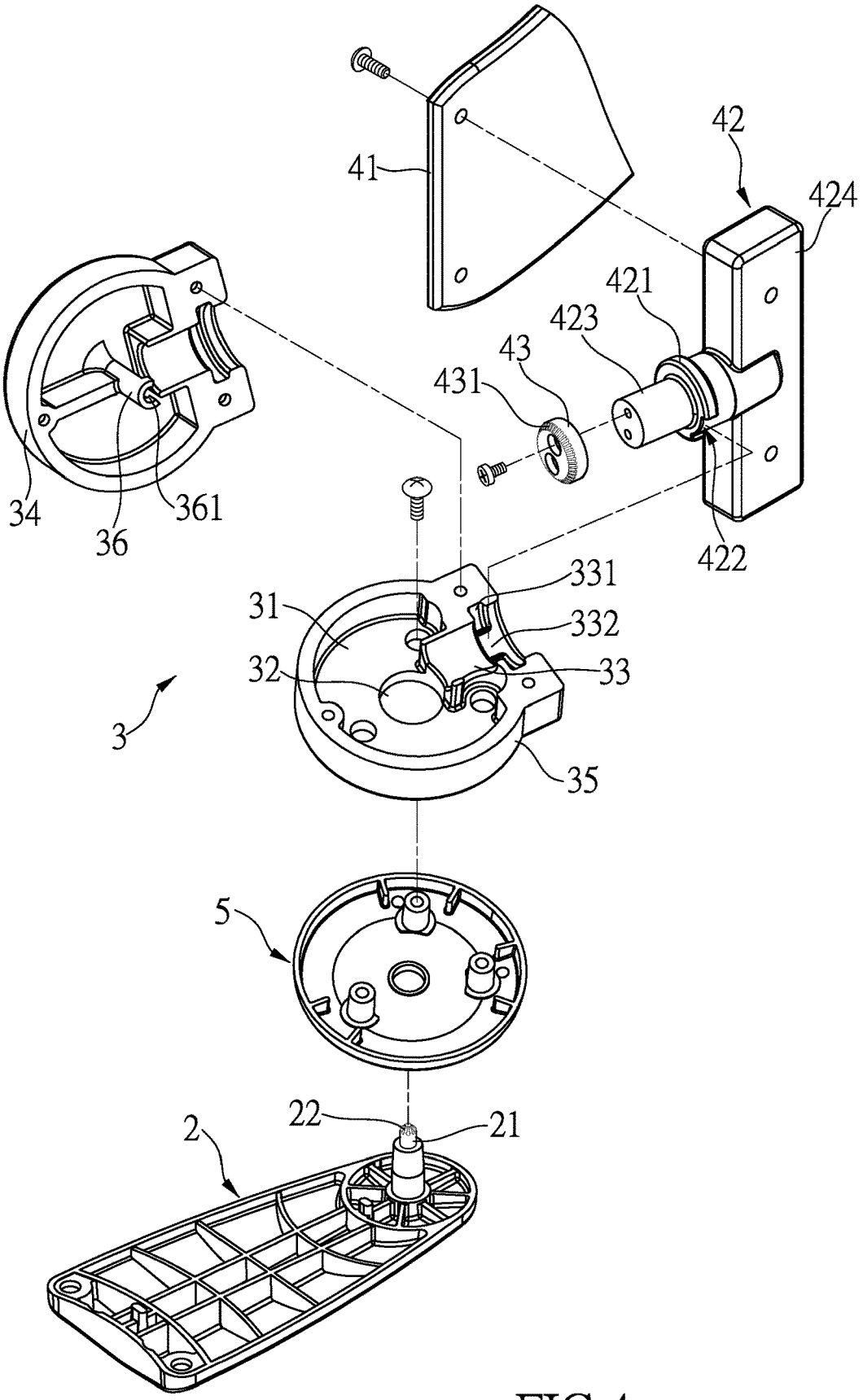
FIG. 4 is a perspective exploded view of an assembly of a blade assembly bracket and a blade of a ceiling fan of the present invention.

The following embodiments of the present invention are herein described in detail with reference to the accompanying drawings. These drawings show specific examples of the embodiments of the present invention. These embodiments are provided so that this disclosure will be thorough and complete, and will fully convey the scope of the invention to those skilled in the art. It is to be acknowledged that these embodiments are exemplary implementations and are not to be construed as limiting the scope of the present invention in any way. Further modifications to the disclosed embodiments, as well as other embodiments, are also included within the scope of the appended claims. These embodiments are provided so that this disclosure is thorough and complete, and fully conveys the inventive concept to those skilled in the art. Regarding the drawings, the relative proportions and ratios of elements in the drawings may be exaggerated or diminished in size for the sake of clarity and convenience. Such arbitrary proportions are only illustrative and not limiting in any way. The same reference numbers are used in the drawings and description to refer to the same or like parts.

It is to be acknowledged that, although the terms 'first', 'second', 'third', and so on, may be used herein to describe various elements, these elements should not be limited by these terms. These terms are used only for the purpose of distinguishing one component from another component. Thus, a first element discussed herein could be termed a second element without altering the description of the present disclosure. As used herein, the term "or" includes any and all combinations of one or more of the associated listed items.

It will be acknowledged that when an element or layer is referred to as being "on," "connected to" or "coupled to" another element or layer, it can be directly on, connected or coupled to the other element or layer, or intervening elements or layers may be present. In contrast, when an element is referred to as being "directly on," "directly connected to" or "directly coupled to" another element or layer, there are no intervening elements or layers present.

In addition, unless explicitly described to the contrary, the word "comprise", "include" and "have", and variations such as "comprises", "comprising", "includes", "including", "has" and "having" will be acknowledged to imply the inclusion of stated elements but not the exclusion of any other elements.

Please refer to FIGS. 1 to 4. As shown in FIG. 1, a ceiling fan 1 includes fan blades which can be folded and unfolded, and the assembly of a blade assembly bracket and a blade of a ceiling fan of the present invention is one of the four assemblies shown in FIGS. 1 to 4, and the ceiling fan having the four assemblies shown in FIGS. 1 to 4 is merely taken as an example.

Detailed structures and operations of the assembly of the blade assembly bracket and the blade of the ceiling fan of the present invention will be described in following paragraphs with reference to FIGS. 3 to 9. As shown in FIGS. 3 to 9, the assembly of the blade assembly bracket and the blade of the ceiling fan of the present invention includes a blade assembly bracket 2, an adaptor 3, and a fan blade 4. The blade assembly bracket 2 is assembled with an end of a fixed shaft 21, and the fixed shaft 21 has a plurality of fixed teeth 22 formed and arranged annularly on other end thereof. The adaptor 3 is pivoted to the blade assembly bracket 2, and includes a receiving portion 31, a through hole 32 and a rotary hole 33. The through hole 32 and the rotary hole 33 are respectively formed on circumferential sides of the adaptor 3 and in communication with the receiving portion 31 axially and radially. The end of the fixed shaft 21 with the plurality of fixed teeth 22 is inserted the through hole 32, and located inside the receiving portion 31. The fan blade 4 includes a blade 41, a rotatable holder 42, and a gear member 43, two ends of the rotatable holder 42 are assembled with the blade 41 and the gear member 43, and a portion, which is assembled with the blade 41, of the rotatable holder 42 is exposed out of the rotary hole 33 of the adaptor 3, and the portion, which is assembled with the gear member 43, of the rotatable holder 42 is pivoted through the rotary hole 33. The gear member 43 is disposed in the receiving portion 31 and has a plurality of rotation teeth 431 engaged with the plurality of fixed teeth 22. With the above-mentioned configuration, when the adaptor 3 is pivoted relative to the blade assembly bracket 2, the plurality of rotation teeth 431 of the gear member 43 are engaged with and rotated along the plurality of fixed teeth 22 of the fixed shaft 21, and the gear member 43 simultaneously drives the rotatable holder 42 and the blade 41 to switch between an initial position and a rotational position, so as to change a range of an inclination angle of the blade 41.

With mutual operations of the aforementioned mechanisms, the centrifugal effect generated by horizontal rotation of the blade assembly bracket 2 during operation of the ceiling fan 1 can cause the fan blade 4 to outwardly unfold from a folded state, so that the blade 41 can simultaneously drive the rotatable holder 42, and the rotatable holder 42 also drives the adaptor 3 to pivotally swing relative to the blade assembly bracket 2; during the pivotal swing process, the plurality of rotation teeth 431 of the gear member 43 are engaged with and rotated along the plurality of fixed teeth 22 of the fixed shaft 21, the adaptor 3 can drive the blade 41 to forwardly rotate about the rotary hole 33, to change the inclination angle of the blade 41, so that the ceiling fan 1 can provide better air circulation effect during operation. When operation of the ceiling fan 1 is stopped, the aforementioned operation is reversely performed to change the fan blade 4 from the outwardly-unfolded state to a folded state.

The detailed features and assembly types of the assembly structure of the blade assembly bracket and the blade of ceiling fan of the present invention are described in following paragraph.

Figure 8:
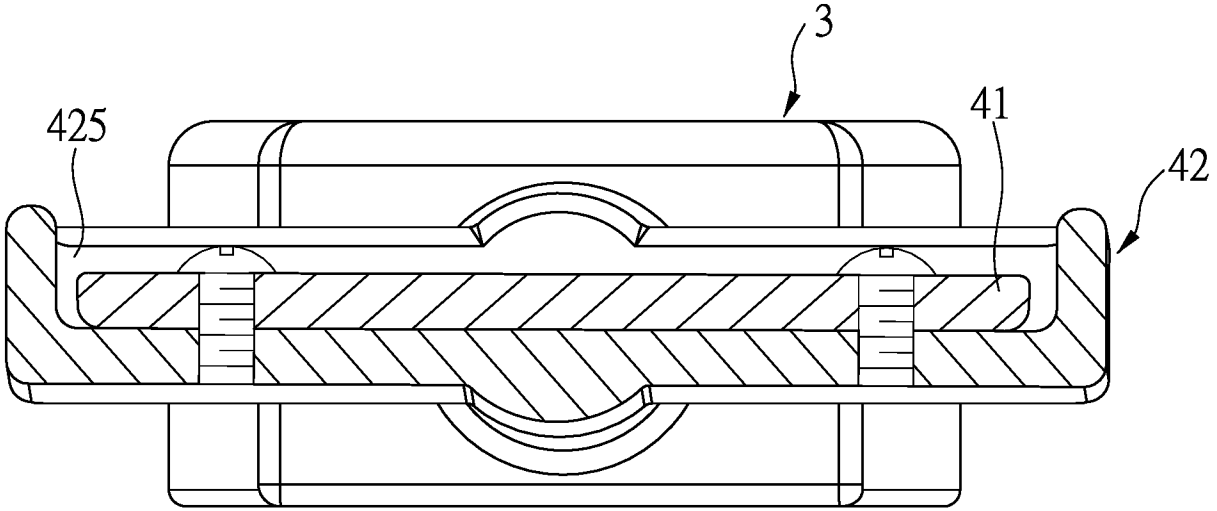
FIG. 8 is a schematic cross-sectional view taken along VIII-VIII of FIG. 3.
Figure 9:
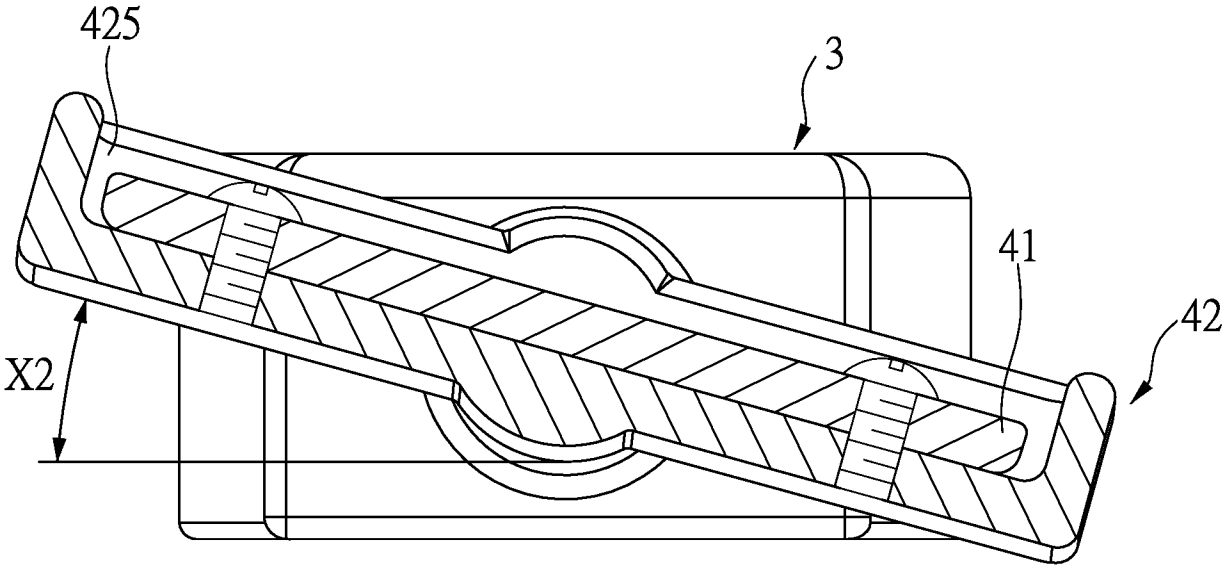
FIG. 9 is a schematic view shows an operation of the assembly of FIG. 8.

The rotary hole 33 has a ring groove 331 formed thereon, the ring groove 331 has a stopper protrusion 332 disposed on a groove bottom face thereof, and the rotatable holder 42 has a curved rib 421 slidably disposed in the ring groove 331, and the stopper protrusion 332 is accommodated in a notch 422 formed between two ends of the curved rib 421, and a length size of the notch 422 is larger than a length size of the stopper protrusion 332. In the present invention, besides using the ring groove 331 to form the sliding operation of the curved rib 421, a stopper protrusion 332 is further accommodated in the notch 422 of the rotatable holder 42, so that the rotation range of the rotatable holder 42 is limited when the two ends of the curved rib 421 are respectively abutted against the two ends of the stopper protrusion 332, and a position of the rotatable holder 42 can be changed from an initial position (a horizontal state of the rotatable holder 42, as shown in FIG. 8) to the rotational position with an inclination angle X2. For example, the inclination angle X2 can be in a range of 7° to 20°, as shown in FIG. 9. Therefore, the blade 41 can be integrally driven by the rotatable holder 42 to prevent the inclination angle of the blade 41 from being upward excessively.

The adaptor 3 comprises an upper cover 34 and a lower base 35 which are connected to each other, the upper cover 34 and the lower base 35 are recessed inwardly opposite to each other to form the receiving portion 31, and the through hole 32 is formed on the lower base 35, the rotary hole 33 is formed on connection portions of the upper cover 34 and the lower base 35, the stopper protrusion 332 is disposed on the lower base 35. The upper cover 34 and the lower base 35 can form the receiving portion 31 to lightly seal the mutual engagement mechanism of the fixed teeth 22 and the rotation teeth 431, so as to reduce intrusion of foreign matter which may impact engaging and rotating process.

The rotatable holder 42 comprises a through shaft portion 423 and a blade assembly portion 424 which are connected to each other, the through shaft portion 423 is pivoted to the rotary hole 33, the curved rib 421 is disposed along an outer periphery of the through shaft portion 423, and the gear member 43 is fixed with an end, opposite to the blade assembly portion 424, of the through shaft portion 423. The blade assembly portion 424 has a blade assembly groove 425 formed thereon, and an end of the blade 41 is accommodated and locked in the blade assembly groove 425.

Figure 5:
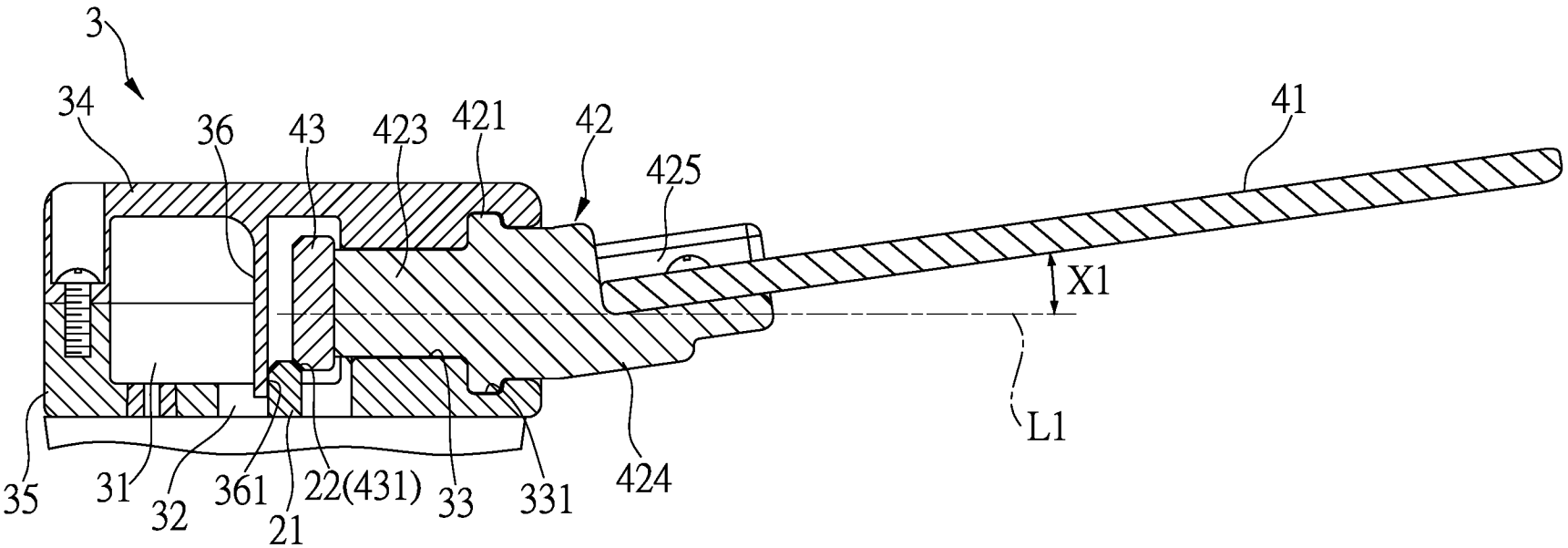
FIG. 5 is a schematic cross-sectional view taken along V-V of FIG. 3.
Figure 6:
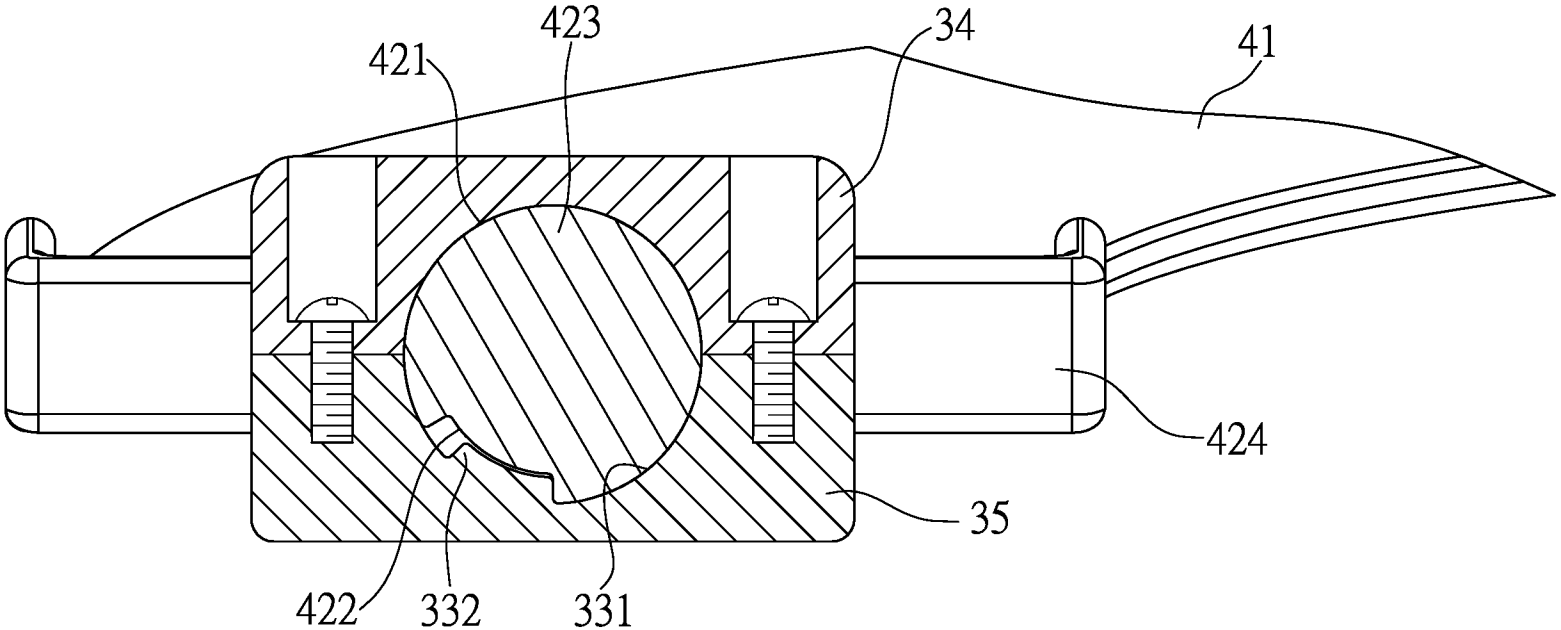
FIG. 6 is a schematic cross-sectional view taken along VI-VI of FIG. 3.
Figure 7:
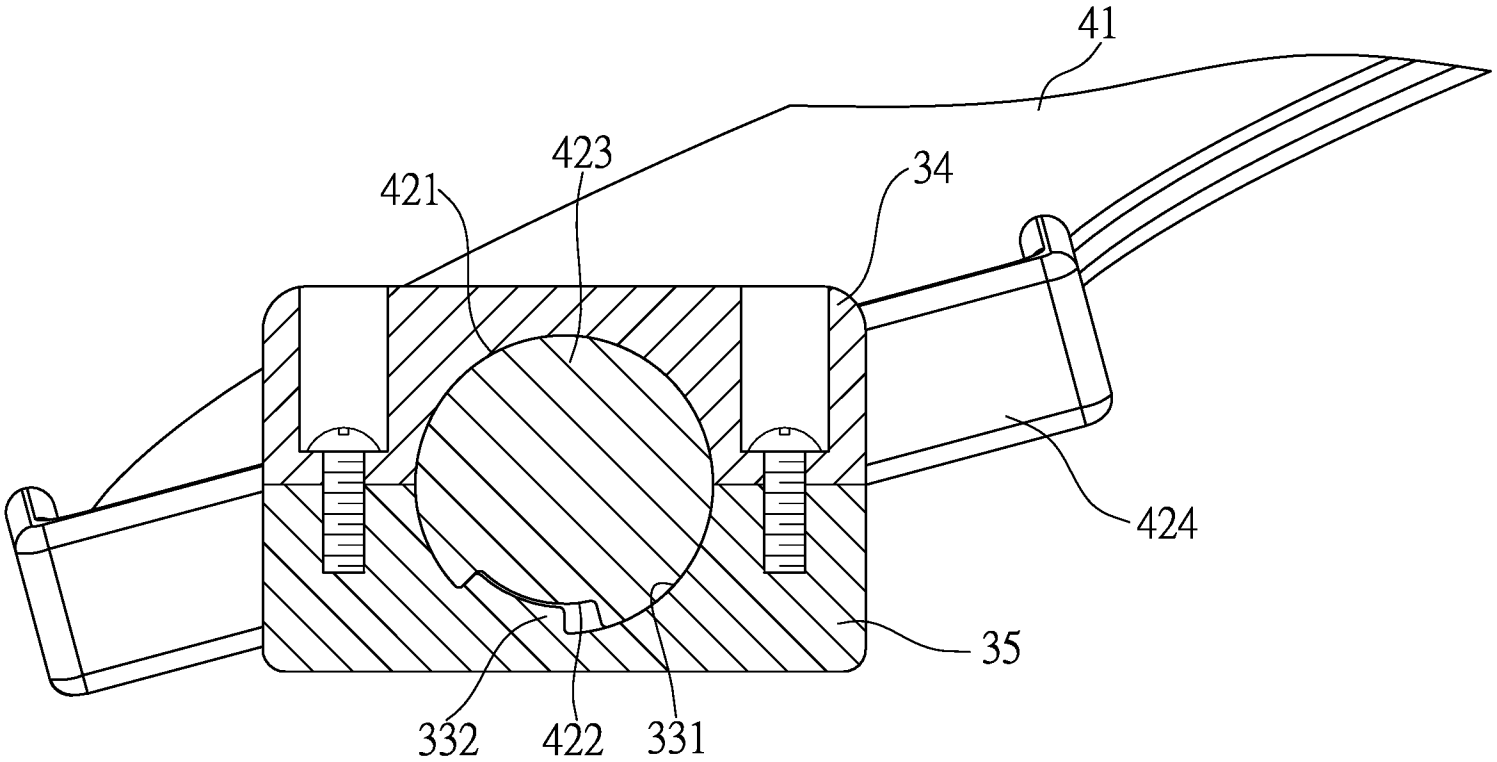
FIG. 7 is a schematic view shows an operation of the assembly of FIG. 6.

Furthermore, the through shaft portion 423 and the blade assembly portion 424 are not at the same horizontal level, and an imaginary line L1 is defined to horizontally extend from the through shaft portion 423 to the blade assembly portion 424, and an upward angle X1 is formed between the imaginary line and the blade assembly portion 424, as shown in FIG. 5, for example, the upward angle can be in a range of 5° to 10°. The configuration of the upward angle can prevent the fan blades 4 from interfering each other during the folding process.

A support rib 36 is disposed in the receiving portion 31 and extended toward the fixed shaft 21, and the support rib 36 has a curved support face 361 formed on a circumferential side thereof and slidably abutted with the circumferential side of the fixed shaft 21. The support rib 36 is extended from an inner portion of the upper cover 34. With the configuration of the curved support face 361 of the support rib 36 slidably abutted with the circumferential side of the fixed shaft 21, the fixed shaft 21 can be prevented from being axially deformed subject to the engaging and rotating force of the gear member 43, so as to make the engagement between the gear member 43 and the fixed shaft 21 and the engaging and rotating process between the gear member 43 and the fixed shaft 21 more stable. In an embodiment, the fixed teeth 22 of the fixed shaft 21 and the rotation teeth 431 of the gear member 43 can be implemented as similar bevel gear types.

The adaptor 3 comprises a rotary disc 5 fixed thereon, and the rotary disc 5 is pivoted to the blade assembly bracket 2, and the fixed shaft 21 is inserted through the rotary disc 5. The rotary disc 5 is assembled with an end of the link rod 51, and other end of the link rod 51 is assembled with the rotary disc 5 of another blade assembly bracket 2, so that the fan blades 4 can be simultaneously driven to unfold and unfold.

The present invention disclosed herein has been described by means of specific embodiments. However, numerous modifications, variations and enhancements can be made thereto by those skilled in the art without departing from the spirit and scope of the disclosure set forth in the claims.

What is claimed is:

1. An assembly of a blade assembly bracket and a blade of a ceiling fan, comprising:

the blade assembly bracket assembled with an end of a fixed shaft fixed thereto, and wherein the fixed shaft has a plurality of fixed teeth formed and arranged annularly on an opposite end thereof;

an adaptor pivotably attached to the blade assembly bracket, and comprising a receiving portion, having a through hole formed in a bottom thereof and a rotary hole formed on a circumferential side thereof and in communication with the receiving portion, wherein the opposite end of the fixed shaft with the plurality of fixed teeth is inserted through the through hole and located inside the receiving portion; and a fan blade comprising a blade, a rotatable holder, and a gear member, wherein two ends of the rotatable holder are respectively assembled with the blade and the gear member, and wherein a portion, assembled with the blade, of the rotatable holder is exposed out of the rotary hole of the adaptor, and a portion, assembled with the gear member, of the rotatable holder is pivoted through the rotary hole, wherein the gear member is disposed in the receiving portion and has a plurality of rotation teeth engaged with the plurality of fixed teeth, and when the adaptor is pivoted relative to the blade assembly bracket, the plurality of rotation teeth of the gear member are engaged and rotated along the plurality of fixed teeth of the fixed shaft, and the gear member simultaneously drives the rotatable holder and the blade to switch between an initial position and a rotational position, to change an inclination angle of the blade.

2. The assembly according to claim 1, wherein the rotary hole has a ring groove formed thereon, and a stopper protrusion disposed on a groove bottom face of the ring groove, and the rotatable holder has a curved rib slidably disposed in the ring groove, and the stopper protrusion is accommodated in a notch formed between two ends of the curved rib, a length size of the notch is larger than a length size of the stopper protrusion, and a rotation range of the rotatable holder is limited when the two ends of the curved rib are abutted against the two ends of the stopper protrusion, respectively, so that a position of the rotatable holder is changed from the initial position to the rotational position with the inclination angle.

3. The assembly according to claim 2, wherein the inclination angle is in a range of 7° to 20°.

4. The assembly according to claim 2, wherein the adaptor comprises an upper cover and a lower base connected to each other, the upper cover and the lower base are recessed inwardly and opposite to each other to form the receiving portion, the through hole is formed on the lower base, the rotary hole is formed on connection portions of the upper cover and the lower base, the stopper protrusion is disposed on the lower base.

5. The assembly according to claim 1, wherein the rotatable holder comprises a through shaft portion and a blade assembly portion which are connected to each other, the through shaft portion is pivoted in the rotary hole, and the curved rib is disposed along an outer periphery of the through shaft portion, and the gear member is fixed with an end, opposite to the blade assembly portion, of the through shaft portion, the blade assembly portion has a blade assembly groove formed thereon, and an end of the blade is accommodated and locked in the blade assembly groove.

6. The assembly according to claim 5, wherein the through shaft portion and the blade assembly portion are not coplanar in orientation, and an imaginary line is defined to horizontally extend from the through shaft portion to the blade assembly portion, and wherein an upward angle is formed between the imaginary line and the blade assembly portion.

7. The assembly according to claim 6, wherein the upward angle is in a range of 5° to 10°.

8. The assembly according to claim 1, wherein the adaptor comprising a support rib disposed in the receiving portion and extended toward the fixed shaft, and the support rib has a curved support face formed on a circumferential side thereof and slidably abutted against a circumferential side of the fixed shaft.

9. The assembly according to claim 1, wherein the adaptor comprises a rotary disc fixed thereon and pivoted to the blade assembly bracket, and the fixed shaft is inserted through the rotary disc.

* * * * *